US006120363A

United States Patent [19]

Dunn

[11] Patent Number: 6,120,363

[45] Date of Patent: Sep. 19, 2000

[54] SELECTABLE ABRASIVE HEAD EXTENDED RECIPROCATING TOOL

[76] Inventor: Herbert Dunn, 12423 Eastern Ave., P.O. Box 202, Chase, Md. 21220

[21] Appl. No.: 09/187,731

[22] Filed: Nov. 9, 1998

[51] Int. Cl.[7] ..... B24B 23/00

[52] U.S. Cl. ..... 451/356; 451/344; 15/22.2; 15/50.2

[58] Field of Search ..... 451/356, 344; 15/22.2, 50.2

[56] References Cited

U.S. PATENT DOCUMENTS

| | | | |
|---|---|---|---|
| 4,685,252 | 8/1987 | Ponce | 451/356 |
| 5,205,079 | 4/1993 | Lashley et al. | 451/356 |
| 5,212,995 | 5/1993 | Robinson et al. | 74/44 |
| 5,833,014 | 11/1998 | Dunn | 173/162.2 |
| 5,885,145 | 3/1999 | O'Mara | 451/356 |
| 5,904,080 | 5/1999 | Anderson et al. | 81/439 |

*Primary Examiner*—Stephen F. Gerrity
*Assistant Examiner*—Shantese McDonald
*Attorney, Agent, or Firm*—Peter Gibson

[57] ABSTRACT

A main body containing an electric motor reciprocally driving a rigid longitudinal extension which is frictionally suspended within a graspable sleeve may be held to guide a selected abrasive tool head coupled to the front end of the extension. Power may be supplied by a battery, rechargeable or replaceable, or by alternating current through a cord. A vacuum connected to a sanding head having a porous pad backed by an airtight manifold and attachable to the main body may run on alternating current or a battery. The sleeve may be connected to the main body to provide a continuous uninterrupted exterior. The speed may be varied with use of a variable resistor. An appropriate length stroke is obtained with a sufficiently large diameter driven disc pivotally connected to the extension with a rigid link arm. The tool may be used for powered sanding, scraping, or scrubbing with a wire brush, a bristle brush or an absorbent pad. Other tasks such as filing, polishing, hoeing, et cetera, in which reciprocating abrasive work is performed can be similarly powered with attachment of an appropriate tool head.

20 Claims, 3 Drawing Sheets

SELECTABLE ABRASIVE HEAD EXTENDED RECIPROCATING TOOL

BACKGROUND OF THE INVENTION

1. Field of the Invention

The general field of the present invention is that of portable electric hand tools, more particularly that of reciprocating portable electric hand tools and most specifically, extended reciprocating portable electric hand tools to which any one of a variety of abrasive work performing tool heads may be attached by means of a coupling.

The innovation disclosed in U.S. Pat. No. 5,833,014 entitled 'Reciprocating Tool Handle' is focussed mainly upon an extended attachment to an existing electrically powered portable reciprocating saw. The saw is recognized as prior art and the handle, comprised of a longitudinal sleeve about the extension, provides a guide for the rigid longitudinal reciprocating extension frictionally suspended therefrom and driving a tool head. It is mentioned in this disclosure that the extension may be integral to such a tool or, preferably, a detachable extension. The tool head may similarly be integral to the extension or, preferably detachable therefrom, and a wide variety of tool heads are applicable.

2. General Background

The device disclosed in the above referenced United States patent comprises a sleeve that is frictionally suspended from a rigid longitudinal extension of a power tool which may be held in guidance of a tool head so extended. As an attachment to an existing power tool, particularly to a portable reciprocating power saw, the limitations inherent to the power saw utilized are thus imposed. These saws are typically characterized by a single speed and a given stroke or travel of the reciprocating member which is typically about three quarters of an inch. This arrangement is suited to a saw quite well but the reciprocating handle opens up many diverse uses which may not be best suited to the single speed and stroke found on such a portable saw.

The relatively short stroke of a reciprocating saw is considered appropriate to the action of sawing while a longer stroke would likely be problematic in tending to grab and throw the workpiece. In other words, the stroke of the saw is considered to be deliberately short in order to ensure safe operation. The blade of a conventional portable reciprocating power saw is also immediately adjacent the main body of the saw and the cutting action enabled thereby is one in which it is desirable to have close proximity to the workpiece.

This is contrasted to the other types of work addressed by the present invention where it is desired to work at a remove from the surface or material being worked in a wide variety of tasks encompassing practically any activity effectable by reciprocal motion of a tool head. With the exception of sawing, which is not considered to be an activity suited to work at a remove, a reciprocating stroke which is substantially longer than that suited to sawing is typically considered desirable. Sanding, with a platform or block, scraping of various kinds, scrubbing with a brush, wire or various types of bristle as well as with a pad, hoeing, filing, polishing, et cetera, provide examples.

Even abrading concrete flash off Jersey barriers benefits from use of a longer stroke as does the cleaning of windows with a soft pad, for instance. Scraping barnacles off the hull of a boat benefits from the more concentrated application of force exerted by the edge of a scraper as does scraping loose paint off of a surface preparatory to painting, both of which are more quickly accomplished with a longer stroke. It is hence recognized that for nearly all purposes other than sawing, a relatively long stroke is considered desirable.

It is also considered that a rigid longitudinal extension as an attachment to a conventional reciprocating portable power saw utilizes a connection between the reciprocating member of the saw and the extension which, lacking any other structure between the handle and the saw, is considered of lesser durability than that generally desired of a conventional power hand tool. Given also that powered sanding of surfaces which would otherwise be sanded manually is considered one of the more significant uses of the reciprocating handle it is further recognized that the amount of dust resulting from powered sanding presents a health hazard while air borne and upon settling, a nuisance in cleaning up.

The use of a conventional portable reciprocating saw as the driving force for an extension of the reciprocating member with one of many other types of tool heads attached thereto is thus considered, in short, to be restrictive of the potential presented by a rigid longitudinal extension frictionally suspended within a sleeve which may be grasped in guidance of any such tool head.

Statement of Need

In recognition of the limitations imposed by using a conventional portable reciprocating power saw as a motive force for a rigid longitudinal extension simply attached thereto and the various applications addressed by a reciprocating extended tool end of various types a need is recognized for an integral reciprocating tool having a frictionally suspended rigid longitudinal extension particularly adapted to meet these various applications.

SUMMARY OF THE INVENTION

Objects of the Present Invention

The encompassing object of the present invention is a tool having an electric motor within a graspable main body driving a rigid longitudinal extension frictionally suspended within a graspable sleeve and possessing a coupling at the front for attachment of a selectable abrasive tool head of any kind.

A first auxiliary object of the present invention is a tool having an electric motor within a graspable main body driving a rigid longitudinal extension frictionally suspended within a graspable sleeve and possessing a coupling at the front for attachment of a selectable abrasive tool head of any kind which possesses a stroke substantially greater than that possessed of a conventional portable reciprocating power saw.

A second auxiliary object of the present invention is a tool having an electric motor within a graspable main body driving a rigid longitudinal extension frictionally suspended within a graspable sleeve and possessing a coupling at the front for attachment of a selectable abrasive tool head of any kind which is a variable in speed.

A third auxiliary object of the present invention is a tool having an electric motor within a graspable main body driving a rigid longitudinal extension frictionally suspended within a graspable sleeve and possessing a coupling at the front for attachment of a selectable abrasive tool head of any kind in which the sleeve is connectible to or continuous with the main body.

Ancillary objects of the present invention include a tool having an electric motor within a graspable main body driving a rigid longitudinal extension frictionally suspended within a graspable sleeve and possessing a coupling at the front for attachment of a selectable abrasive tool head of any kind utilizing a battery or power cord, and to which a vacuum may be provided to a tool head for convenient removal of abraded particles.

Principles Relating to the Present Invention

A number of independent aspects considered desirable of a tool particularly adapted for driving a tool head at a remove from the motive force within a graspable main body upon an end of a rigid longitudinal extension frictionally suspended within a graspable sleeve are recognized in the above stated objects.

It is first recognized that a coupling at the front end of the rigid longitudinal extension will enable attachment of a selected abrasive tool head of any kind. Several types of couplings are specifically recommended: threaded, resilient member catch, and outwardly displaceable spring loaded ball bearing engaging a notch in a straight shaft of the tool head.

Secondly, it is recognized that the stroke, i.e. the travel or length of displacement in reciprocation, is preferably substantially greater than that possessed of a conventional portable reciprocating power saw which, as mentioned above, typically possesses a stroke of about three-quarters of an inch. Powered sanding, scraping, scrubbing, et cetera, are all tasks which would benefit from a stroke substantially greater than that possessed of a conventional portable power saw. With regard to effecting a longer stroke than found on a conventional portable reciprocating power saw it is noted that such tools typically possess a rotary electric motor driving a disc having a link arm attached peripherally whereby the diameter of the disc becomes the effective length of the stroke imparted. A larger diameter disc upon the same motor will result in a longer stroke.

It is thirdly recognized, for reasons similar to the desirability of a comparatively longer stroke, that a slower and preferably variable speed of reciprocation be available. With regard to obtainment of variable speed it is recommended that a variable resistor be included in the control circuit of the motor such that an increase in resistance diminishes the amperage reaching the motor and thereby slows the same.

It is further recognized that the graspable sleeve about the rigid longitudinal extension preferably be connected to or continuous with the graspable main body of the tool, i.e. that this sleeve, which is intended to be grasped in order to guide the tool head, preferably be structurally consistent with the main body of the tool. It is not necessary that this sleeve be integral with the main body, the sleeve may be removably attachable thereto or wholly separate therefrom, but the sleeve and the main body preferably possess a rigid connection with each other and together further preferably possess an exterior surface at the connection between the two which is substantially continuous and without an interruption.

It is also recognized that two basic types of power supply may be utilized: battery or alternating current. In the case of a battery it is recognized that it is desirable to be able to replace the battery if contained in the main body as is recommended and also that a rechargeable battery is of utility. Alternating current may alternatively be supplied through a cord from a standard power outlet. This will enable provision of greater power and reduce the weight of the tool simultaneously. The mobility of the tool, however, is adversely affected.

Lastly it is considered that in sanding, particularly, it is desirable to have a vacuum applied proximate the working surface of the tool head in order to prevent the dust created by the sanding from becoming airborne and dispersed about. Several elements are required to provide this feature. The sanding pad must be porous in order to allow suction to gather the dust and a manifold which is substantially airtight through which the vacuum is applied must back a vacuum sanding head. It is suggested that suction, i.e., a negative pressure with regard to ambient, be supplied through a flexible tube connected to a vacuum separate from the tool. Alternatively, an internal bore through the rigid longitudinal extension may be connected to a vacuum which in either case may be portable and carried by the operator, preferably upon the waist or back, supported by a belt or strap. It is commented that vacuums typically operate upon the principle of a turbine or blower driven by an electric motor which blows air out of a chamber, i.e. evacuates the chamber.

It is recognized, however, that an embodiment fulfilling the principles relating to the present invention need possess only a graspable main body with an electric motor contained therein which drives a reciprocating rigid extension that is frictionally suspended from a graspable sleeve about the extension, said reciprocating, frictionally suspended rigid extension further possessing a front end with a coupling to which a tool head is attachable. As it is implicitly desired to be able to grasp the main body as well as the sleeve a handle upon the main body is further considered implicitly desirable.

Other options, alternatives, and details of a preferred embodiment in accordance with the principles relating to the present invention may be appreciated with a reading of the detailed discussion below, particularly if conducted with reference to the drawings attached hereto.

DETAILED DESCRIPTION OF THE PREFERRED EMBODIMENT

Figure 1:
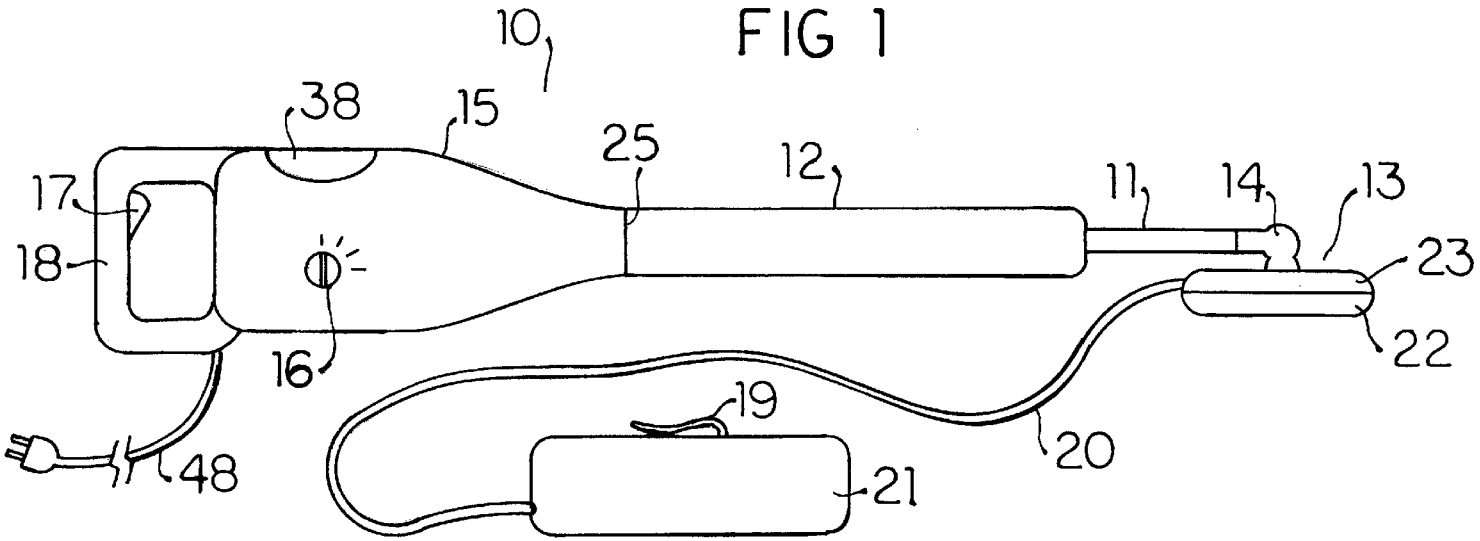
FIG. 1 is a plain elevational view taken from a side of a preferred embodiment of the principles relating to the present invention having a sleeve detachable from the main body and equipped with a vacuum sanding head and a power cord.

FIG. 1 depicts a tool 10 possessing a rigid longitudinal extension 11 protruding from the front end of a graspable sleeve 12 which has a sanding head 13 attached to the front end. The sanding head 13, or any other type of tool head, is attached by means of a coupling 14 which preferably permits removable attachment of a tool head. At the rear end of the tool 10 is the main body 15, i.e. housing, upon which a dial type speed control 16 is seen, along with a battery access panel 38 on top. A finger actuated power supply switch 17 is seen located on the top inside corner of a grip style handle 18 at the rear of the main body 15. A power supply cord 48 is also seen depending from said handle 18.

Also seen in FIG. 1 is a flexible hose 20 attached at one end to a vacuum 21 and at the other end to a porous sanding pad 22 through a manifold 23 which is substantially airtight. The vacuum 21 preferably is carried on one's back or t one's waist with a separate strap or upon one's belt for which a clip 19 is shown in FIG. 1. A part line 25 is also seen in FIG. 1 where the sleeve 12 is connected to the main body 15. It is preferred that such a connection be rigid and provide a substantially continuous juncture such that the exterior surface of both components is substantially uninterrupted. Many of these features are unnecessary to fulfillment of the principles relating to the present invention and some of the essential features are hidden from view. The vacuum 21 is wholly optional, for instance, any type of tool head may be substituted for the sanding head 13 depicted herein and the sleeve 12 and the main body 15 may constitute a single piece.

Figure 2:
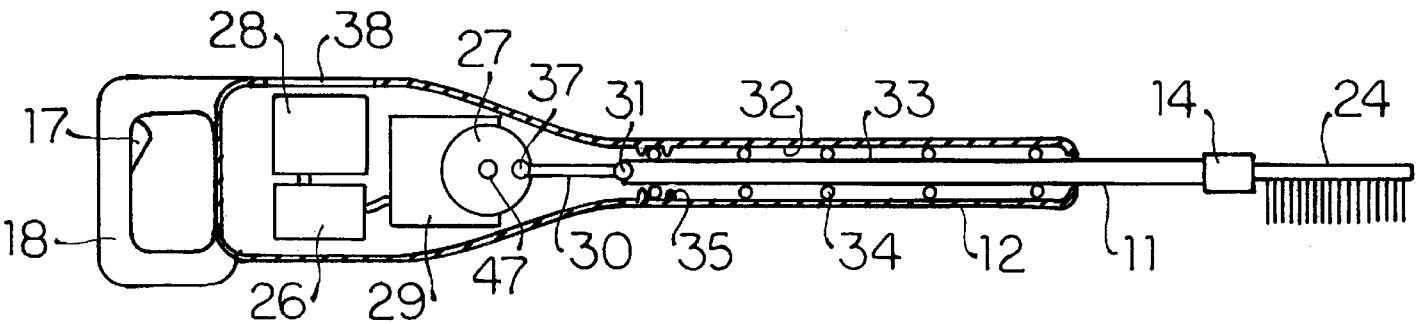
FIG. 2 is a plain elevational view taken from a side of a preferred embodiment of the principles relating to the present invention cut away to illustrate the interior components including a battery, having a sleeve continuous with the main body, and equipped with a wire brush head.

FIG. 2 reveals several components necessary to a tool 10 in accordance with the principles relating to the present invention. The rigid longitudinal extension 11 must be frictionally suspended within the graspable sleeve 12 and this is considered to be best effected with the use of bearings 34 which are located in contact with an interior sleeve surface 32 and a rigid longitudinal extension exterior surface 34. The bearings 34 depicted in FIG. 2 are of a circular race type which are held in place by annular ridges 35 extending inward from the sleeve interior surface 32. It is recommended that at least two such bearings 34 be deployed, if not more, with at least one such bearing 34 proximate the front of the sleeve 12 and at one other bearing 34 proximate the rear of the sleeve 12.

An alternative approach to frictional isolation of the rigid longitudinal extension 11 inside the sleeve 12 is suggested in the manner preferred in U.S. Pat. No. 5,833,014 wherein the sleeve 12 is held between two springs, preferably both under compression, and each spring is in contact with a collar about the rigid longitudinal extension 11. The sleeve 12 need not be of wholly medial to the springs and the collars about the rigid longitudinal extension 11, however. The sleeve 12 might have internal collars, similar to the annular ridges 35 suggested above for retaining the position of bearings 34. In this manner the springs and the collars, on both the sleeve 12 and the rigid longitudinal extension 11, would be internal to the exterior of the sleeve 12. Other means of frictionally suspending or isolating the rigid longitudinal extension 11 within the sleeve 12 may be devised.

Proximate the juncture of the sleeve 12 and the main body 15 may be seen a front pivot 31 which provides an inextensible but pivotable connection between the rear end of the rigid longitudinal extension 11 and the front end of a rigid link arm 30 which, in a preferred embodiment as shown, is attached at the other, rear, end by means of a rear pivot 37 to a disc 27. This disc 27 has an axis 47 which is driven by an electric motor 29.

The diameter of the disc 27 limits and the distance between the rear pivot 37 from that axis 47 determines the reciprocal displacement, or stroke, imparted to the rigid longitudinal extension 11 and hence to any tool head attached to the front end of the same. The stroke length is equal to twice the radial distance of the rear pivot 37 from the disc axis 47. It is possible to allow adjustment of the length of the stroke given to the rigid longitudinal extension 11 and any tool head attached thereto by either replacing the disc 27 or altering the radial distance of the rear pivot 37 from the disc axis 47.

In any case wherein a rotating disc 27 is utilized to obtain reciprocating drive of the rigid longitudinal extension 11, at least one rigid link arm 30 is considered necessary which is connected to the disc 27 with a rear pivot 37 which permits full rotation of the rear pivot 37 with respect to the rigid link arm 30 and is connected to the rear end of the rigid longitudinal extension 11 with a forward pivot 31 which allows the degree of rotation necessary of the linkage but which need not be fully rotatable.

An electric motor 29 is another necessary element which provides a driving force which is rotational in form and a disc 27 and rigid link arm 30 are considered to be the best means known of providing the ample stroke length desired. A cam shaft and follower will also translate the rotational drive provided by an electric motor 29 into the reciprocal displacement necessary but the obtainment of a sufficiently long stroke by this approach is considered problematic though this or any other method which will provide this translation of motion is considered within the principles relating to the present invention.

Most people have alternating current outlets and extension cords and while a battery 28 is depicted as internal to the main body 15 of the tool 10 which is understood to supply the power for the electric motor 29 as controlled by the power supply switch 17 the use of either the power supply cord 48 directly connected to such an outlet or through an extension cord operably connected to a standard alternating current power outlet is considered preferable to a battery 28 for availability of superior power. A battery 28 supplied power source is preferred for greater mobility as neither a cord nor access to an alternating current outlet is required. It is further preferred that the battery 28 be of a rechargeable type such as nickel cadmium. For either replacement of the battery 28 or recharging the same a battery access panel 38 permitting removal of the battery 28 form the main body 15 of the tool 10 is recommended.

As it is desired to be able to vary the speed of the reciprocation of the rigid longitudinal extension 11 and any tool head attached thereto such as a sanding platform 13 or wire brush head 24 as depicted, respectively, in FIGS. 1 & 2, the use of a variable resistor 26 is recommended. The control may be obtained by a dial control 16 as depicted in FIG. 1 or other suitable means. The trigger style power supply switch 17 depicted in both these figures could also be utilized to operate the variable resistor 26 in addition to mere supply of electric current from either a battery 28 or from an external alternating current source.

The handle 18 depicted in both FIGS. 1 & 2 is similarly to a type which is considered to be the best for most operators of a tool 10 in accordance with the principles relating to the present invention, however, many other styles are readily applicable and no distinct handle 18 per se is necessary. It is necessary that the main body 15 be graspable but if the same is of sufficiently small size, and particularly if the rear end of the same is of small enough effective diameter, then the main body 15 itself may be readily grasped with one hand while the sleeve 12 is grasped with the other.

The vacuum 21 and associated flexible hose 20 and sanding head 13 possessing a porous pad 22 backed by a substantially airtight manifold 23 are all strictly optional accessories. It is further preferred of this additional and optional system that the vacuum 21 be carried on one's person, as previously mentioned. In this most preferred embodiment of the principle relating to the present invention it is further suggested that the motive force for both the rigid longitudinal extension 11 and the vacuum 21 be supplied from an alternating current outlet through a supply cord 48 connected to the tool 10 and from there to the vacuum 21.

But the vacuum may either be supplied by a battery 28 internal to the main body 15 or another battery within the vacuum 21. In either case it is deemed desirable to have a separate electric motor within the vacuum 21.

Regardless of the type of power supply or type of vacuum 21 utilized the latter is intended to supply suction through a dust and small particle porous sanding pad 22 by effecting a negative pressure with regard to ambient in the backing manifold 23. The connection depicted in FIG. 1 between the vacuum 21 and the manifold 23 is through a flexible, substantially airtight hose 20. As an alternative it is suggested that the rigid longitudinal extension 11 might possess a bore connectible at the front end to the manifold 23 and at the rear to the vacuum 21 though this latter connection would still require use of a flexible hose 20. The advantage to this alternate means of supplying suction is that no forward external hose 20 would be required.

In any case wherein a vacuum 21 is desired the purpose is to draw dust and small particles created while sanding through a porous sanding pad 22 and convey the same to a disposable bag or other container associated with the vacuum which will permit convenient disposal of the dust and small particles so collected. This will reduce the amount of clean up required after sanding as well as reduce the amount of air borne dust and particles created in sanding thereby reducing the health hazard posed by these air borne particles.

Figure 3:
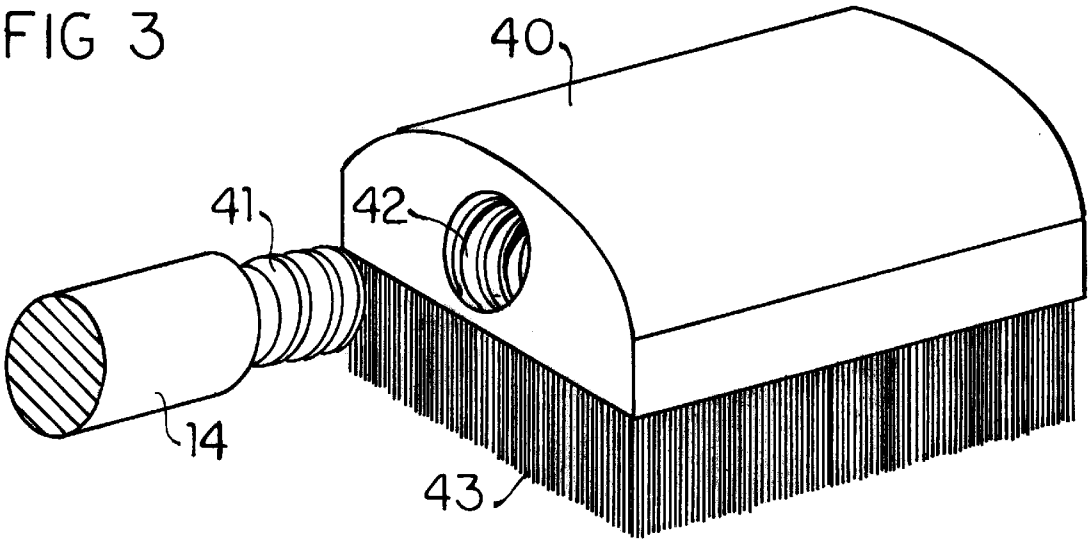
FIG. 3 is an isometric detail view of a threaded coupling and a mating soft bristle brush tool head.

It is considered paramount to the present invention that different types of tool heads be attachable to the front end of the rigid longitudinal extension 11. For this purpose the front of the rigid longitudinal extension 11 terminates in a coupling 14. The type of coupling 14 utilized in the embodiments of the principles relating to the present invention depicted in FIGS. 1 & 2 is indeterminate as many suitable type couplings 14 are known and all are satisfactory with regard to said principles. One well known type of coupling 14 is depicted in FIG. 3 wherein the coupling 14 possesses male threading 41 which engages female threading 42 in a soft brush head 40 which has a great plurality of soft bristles 43. This type of brush is contrasted to a wire brush 24 which is depicted in FIG. 2. The latter is particularly useful in knocking loose paint from a surface preparatory to painting, for example. A soft brush 40 is generally useful for cleaning.

Figure 4:
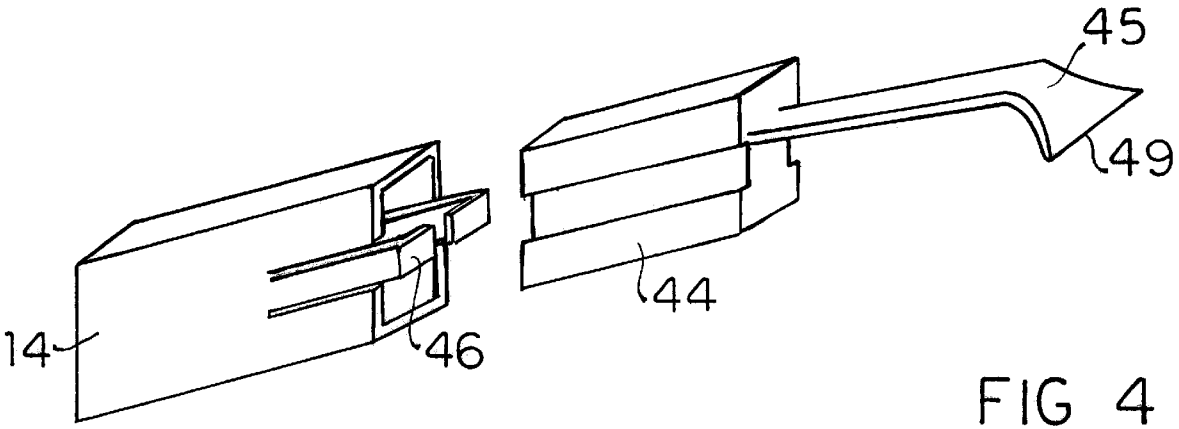
FIG. 4 is an isometric view of a resilient member catch type coupling and a scraping head.

Another type of coupling 14 which is specifically suggested is a catch type as depicted in FIG. 4. This type utilizes at least one laterally resilient member 46 or catch which engages the tool head which, in the particular case depicted in FIG. 4, is a scraper 45 which possesses a substantially smooth lower edge 49. This tool head is also quite useful for removing loose paint and for scraping barnacles off the hulls of boats. A scraper 45 which is broader and substantially straight in line with the tool 10 is particularly useful for removing linoleum floor tiles.

Figure 5:
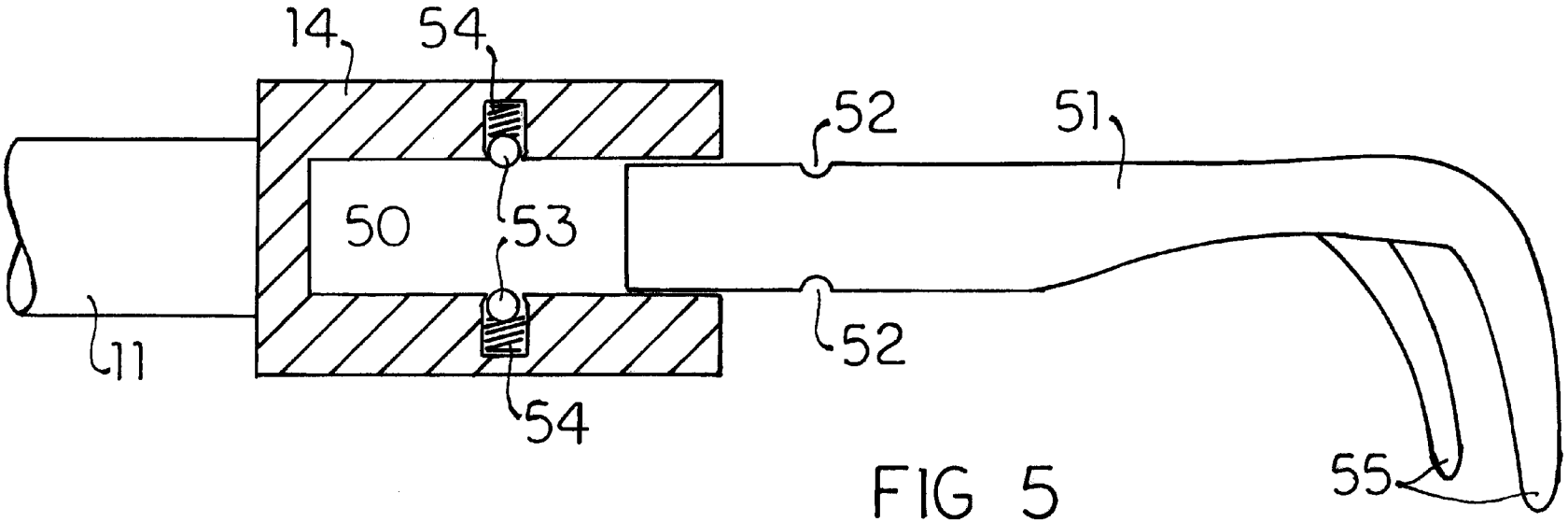
FIG. 5 is a plain elevational view taken from a side of a displaceable ball bearing coupling cut away together with a clawed hoe head.

A third type of coupling 14 utilizing at least one spring 54 loaded ball bearing 53 is depicted in FIG. 5. The tool head, which in this case is a garden hoe 51 possessing at least one claw 55 or prong, has a straight shank with at least one notch 52 which is engaged by a spring 54 loaded ball bearing 53 when fully inserted into the longitudinal cavity 50 of the coupling 14. This type of coupling is considered to be the most preferred in fulfillment of the principles relating to the present invention because of the ease of attachment and detachment enabled.

It is also noted that all the tool heads, sanding head 13, wire brush head 24, soft brush 40, scraper 45 and garden hoe 51, are considered to perform the task intended of the same with a substantial stroke and that the actual work is accomplished with abrasion. It is noted in this matter that the word 'abrade' is directly derived from Latin and means to scrape off. Hence while sanding is an obvious form of abrasion, as is scrubbing, scraping is also a form of abrading as is the work done in tilling. Filing is another type of abrading considered eminently appropriate of a tool head used in conjunction with a tool 10 in accordance with the principles relating to the present invention.

The above description is intended to provide one practiced in the art with what is considered to be the best manner of making and using a tool 10 in accordance with the principles relating to the present invention. Said description neither restricts the scope of the invention nor the rights and privileges accorded by Letter Patent for which I claim:

What is claimed is:

1. An extended reciprocating tool, intended to drive any tool head adapted to perform any type of abrasive action including but not restricted to sanding, scraping, and scrubbing in a reciprocating stroke displacement, said extended reciprocating tool comprising:

a graspable main body containing an electric motor, a power supply, a graspable sleeve, a rigid longitudinal extension, frictional suspension means, and a coupling;

said graspable sleeve comprising a rigid longitudinal structure possessing a longitudinal interior through which said rigid longitudinal extension extends longitudinally;

said rigid longitudinal extension possessing a rear end mechanically linked to said electric motor such that operation of said electric motor exerts a reciprocating drive upon said rear end of said rigid longitudinal extension;

said frictional suspension means frictionally suspending said rigid longitudinal extension within said graspable sleeve such that reciprocal longitudinal displacement of said rigid longitudinal extension with respect to said graspable sleeve without direct contact between said rigid longitudinal extension and said graspable sleeve is facilitated;

said rigid longitudinal extension possessing a front end terminating in said coupling, said coupling providing mechanical attachment of an abrasive tool head to said front end of said rigid longitudinal extension;

operation of said electric motor within said graspable main body thereby causing reciprocation of said rigid longitudinal extension with respect to said graspable sleeve which may be grasped by one hand and held immobile with respect to the reciprocating rigid longitudinal extension;

whereby mechanical attachment of a selected abrasive tool head upon said front end of said rigid longitudinal extension with said coupling, grasping of said main body with one hand, grasping of said sleeve with another hand, and operation of said electric motor effects powered reciprocal displacement of said tool head in a manner which is readily guided in the performance of a selected abrasive task at a remove from said main body.

2. The extended reciprocating tool of claim 1 further possessing a handle upon said main body.

3. The extended reciprocating tool of claim 1 further possessing variable speed control including a variable resistor.

4. The extended reciprocating tool of claim 3 wherein said variable speed control is operated with a dial.

5. The extended reciprocating tool of claim 1 wherein said sleeve and said main body are constructed in a single piece.

6. The extended reciprocating tool of claim 1 wherein said sleeve is structurally connectable with said main body.

7. The extended reciprocating tool of claim 6 wherein said sleeve is structurally connectable with said main body in a manner which is continuous such that there is no significant interruption between exterior surfaces of said sleeve and said main body.

8. The extended reciprocating tool of claim 1 wherein said coupling possesses threading which mates with threading upon a tool head.

9. The extended reciprocating tool of claim 1 wherein said coupling is of a type utilizing a longitudinal cavity and at least one laterally displaceable member mechanically engaging a tool head inserted in said longitudinal cavity.

10. The extended reciprocating tool of claim 9 wherein at least one said laterally displaceable member comprises a ball bearing laterally displaced outward by insertion of a tool head into said longitudinal cavity and engaging a depression in a lateral surface of said tool head.

11. The extended reciprocating tool of claim 1 further possessing a vacuum attachment comprised of a sanding head possessing a small particle porous pad, a substantially airtight manifold and the capability of supplying a negative pressure upon said manifold with the use of a vacuum operably connected thereto.

12. The extended reciprocating tool of claim 11 wherein said vacuum is attachable to one's person.

13. The extended reciprocating tool of claim 11 wherein said vacuum is operably connected to said manifold through a flexible hose.

14. The extended reciprocating tool of claim 1 further including a power cord through which said electric motor may be supplied with alternating current from a standard alternating current supply source.

15. The extended reciprocating tool of claim 1 further including a battery operably connected to said electric motor and thereby capable of supplying said electric motor with electric current.

16. The extended reciprocating tool of claim 15 wherein said battery is rechargeable.

17. The extended reciprocating tool of claim 15 further including a battery access panel as a portion of said main body enabling removal and replacement of said battery from and into said main body.

18. The extended reciprocating tool of claim 1 wherein said electric motor is mechanically linked to said rigid longitudinal extension through a rigid link arm possessing a forward pivotable connection to the rear end of said rigid longitudinal extension and a rearward pivotable connection to a rotatable disc possessing an axis driven by said electric motor.

19. The extended reciprocating tool of claim 18 wherein said rotatable disc is of a sufficient diameter and said rearward pivotable connection of said rigid link arm is of a sufficient radial distance from said axis to provide a reciprocal displacement imparted to said rigid longitudinal extension which is greater than one inch.

20. The extended reciprocating tool of claim 19 wherein said rotatable disc is of a sufficient diameter and said rearward pivotable connection of said rigid link arm is of a sufficient radial distance from said axis to provide a reciprocal displacement imparted to said rigid longitudinal extension which is approximately one and one half inches.

* * * * *